United States Patent [19]

Karp

[11] 4,050,736

[45] Sept. 27, 1977

[54] COMPACTABLE FURNITURE

[76] Inventor: Natan Karp, 9 Tel-Hai Str., Jerusalem, Israel

[21] Appl. No.: 674,401

[22] Filed: Apr. 7, 1976

[51] Int. Cl.[2] ..... A47B 39/00

[52] U.S. Cl. ..... 297/135; 297/239; 297/DIG. 2; 297/DIG. 3

[58] Field of Search ..... 257/456, 446, DIG. 2, 257/DIG. 3, 462

[56] References Cited

U.S. PATENT DOCUMENTS

| | | | |
|---|---|---|---|
| 1,660,119 | 2/1928 | Decker | 297/239 X |
| 2,620,018 | 12/1952 | Pagano | 297/239 X |
| 3,220,769 | 11/1965 | Regan | 297/456 X |
| 3,371,963 | 3/1968 | Weller | 297/446 X |
| 3,438,676 | 4/1969 | Brosk | 297/456 X |
| 3,556,586 | 1/1971 | Beardmore | 297/DIG. 2 |
| 3,604,749 | 9/1971 | Parmett | 297/DIG. 2 |

*Primary Examiner*—Roy D. Frazier
*Assistant Examiner*—Peter A. Aschenbrenner
*Attorney, Agent, or Firm*—Ernest F. Marmorek

[57] ABSTRACT

A compactable furniture unit having two chairs and a shaped body, each chair having a seating surface, an upwardly extending backrest and two upwardly extending armrests; the shaped body being adapted to fit into the area defined by the seating surface, backrest and armrests of one of the chairs and to extend upwardly beyond the top of at least one of said armrests. The second chair of the unit is adapted to be inverted and to rest with its armrests on the armrests of said first chair, so that said second chair is maintained in this position atop said first chair by said shaped body thus forming a compact unit.

5 Claims, 3 Drawing Figures

COMPACTABLE FURNITURE

FIELD OF INVENTION

The present invention relates to a compactable furnishing unit. More particularly the present invention relates to a unit comprising two chairs and a shaped body as hereinafter defined which together are compactable into a single unit array pleasing to the eye.

BACKGROUND OF THE INVENTION

Compactable and combination furniture of various types are known in the art, however, the demand for new and different compactable furnishing units is still constantly increasing to fill the need for such units for limited dwelling spaces such as one and two room apartments and even to provide furnishing in larger apartments for children's rooms.

SUMMARY OF THE INVENTION

To meet this need according to the present invention there is provided a compactable furnishing unit comprising two chairs and a shaped body as hereinafter defined wherein each chair is characterized by a seating surface, an upwardly extending backrest and two upwardly extending armrests, said units further being characterized in that said shaped body is adapted to fit into the area defined by the seating surface, backrest and armrests of one of said chairs and to extend upwardly beyond the top of at least one of said armrests and that the second chair of said unit is adapted to be inverted and to rest with its armrests on the armrests of said first chair and with a portion of said shaped body extending into the area defined by the seating surface, backrest and armrests of said second chair whereby the armrests of said second inverted chair are aligned with and maintained in position atop the armrests of said first chair by said shaped body and said unit of two chairs and a shaped body thereby form a compact unit.

The term shaped body as used herein is intended to define any geometric body having the characteristics and fulfilling the function defined above, such a cylindrical or hour-glass shaped body in instances in which the inner surface plane defined by the backrest and sidearms of the chairs define a curved arc, or a quadratic prism shape in instances in which the inner surfaces of said backrest and sidearms are straight and define three sides of rectangle.

In preferred embodiments of the present invention said shaped body will itself be utilizable as a table stool and/or hassock when said unit is separated into its three component parts.

The invention will be better understood from a consideration of the following illustrative description read in conjunction with the accompanying drawings from which other features and advantages of the present invention as well as some of its preferred embodiments will be apparent.

It is stressed however, that the particulars shown are by way of example and for purposes of illustrative discussion only and are presented in the cause of providing what is believed to be the most useful and readily understood description of the principles and conceptual aspects of the invention. In this regard no attempt is made to show structural details of the system and its apparatus in more detail than is necessary for a fundamental understanding of the invention, the description taken with the drawings making apparent to those skilled in the art of combination furniture how the several forms of the invention may be embodied in practice.

DESCRIPTION OF PREFERRED EMBODIMENTS

Figure 1:
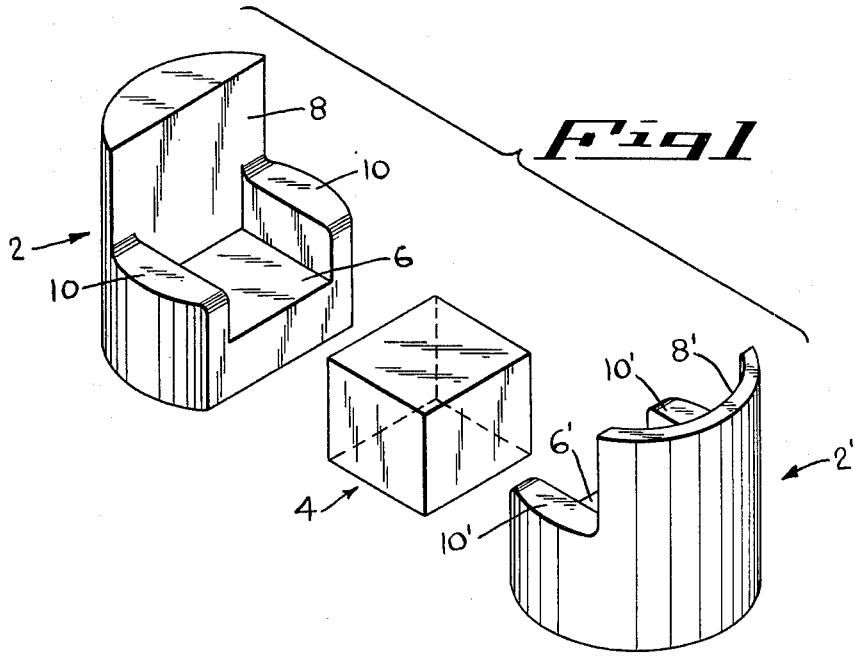
FIG. 1 is a perspective view of two chairs and a shaped body which form three components of a unit of the present invention.

Referring first to FIG. 1 there is shown two chairs 2, 2' and a rectangularly shaped three dimensional body 4 which form three components of a unit of the present invention when arranged for utilization and use of each of the component pieces. Thus shaped body 4 can act as a table or hassock for two people using the chairs 2 and 2' as shown, each chair is characterized by a seating surface 6, 6' and upwardly extending backrest 8,8' and two upwardly extending arm rests 10, and 10' respectively. According to the present invention the shaped body 4 is adapted to fit into the area defined by the seating surface 6 backrest 8 and armrests 10 of one of said chairs (arbitrarily chair 2 for description purposes) and to extend upwardly beyond the top of at least one of said armrests 10 (and beyond the top of both, if they are of equal height). The second chair 2' of said unit is adapted to be inverted and to rest with its armrests 10' on the armrests 10 of said first chair and with a portion 12 of said shaped body extending into the area defined by the seating area 6' , backrest 8' armrests 10 of said second chair 2' , whereby the armrests 10' of said second chair 2' are aligned with and maintained in position atop the armrests 10, of said first chair by said shaped body, to form a single compact unit array. Such an array is shown in the cross-sectional view of FIG. 2.

Figure 2:
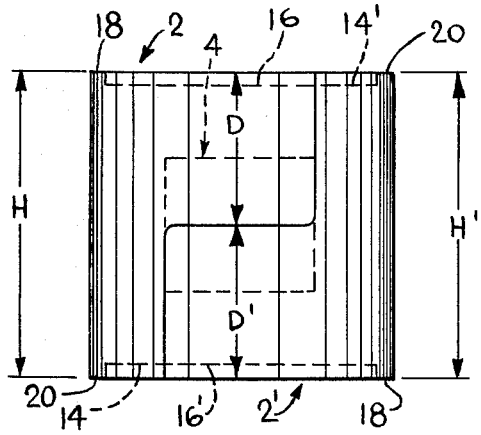
FIG. 2 is a cross sectional view of two chairs and a shaped body of the present invention in their single unit compact array.
Figure 3:
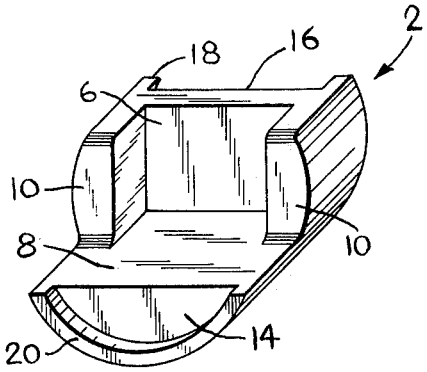
FIG. 3 is a perspective view of one of the chairs of a unit of the present invention.

In the preferred embodiment shown in FIG. 2, the height D of the armrests of said first chair 2 and the height D' of the armrests of said second chair 2' when combined, are substantially equal to the height H, H' of each of the backrests of said chairs whereby when said second chair is inverted onto said first chair, the top surface 14,14' is substantially continguous with the plane of the bottom 16,16' of the other chair. Optionally, as shown in FIGS. 2 and 3 both said chair bottom 16' and backrest top 14' can be provided with peripheral rims 18,20 adapted to form a continuous rimmed table surface when in compact unit form, while giving the semblence of a leglike rim to the chairs of said unit when in individual use.

It will be evident to those skilled in the art that the chairs of the present invention can take many shapes while still being adapted for the intended compactable array. Thus as shown in FIGS. 1 and 3 the outer back and side surface of each chair can form a cylindrical section which upon inversion and superposition with a second similar chair can define, in compact array, a substantially contiguous cylindrical shape. Such a configuration is preferred for children's furniture as when the backs of each chair of said unit is curved each of said chairs can be placed on its back on a floor surface and be adapted to serve as a sideway rocking chair as illustrated in FIG. 3. Of course the outer surface of the backs and sides of said chairs can be straight to define rectangularly shaped prisms in compact array. Irrespective of the outer surface of the backs of the chair, the inner surface of said backrests can vary and for example be curved as illustrated by backrest 8' or straight as illustrated by backrest 8, in FIG. 1.

The component furniture parts of the units of the present invention can be made from any material used in furniture construction. Preferred however especially for children's furniture, are articles made of molded plastic such as hollow plastic chairs and shaped bodies made by a centrifugal rotary process.

It will be evident to those skilled in the art that the invention is not limited to the details of the foregoing illustrative embodiments and that the present invention may be embodied in other specific forms without departing from the spirit or essential attributes thereof. It is therefore desired that the present embodments be considered in all respects as illustrative and not restrictive, reference being made to the appended claims, rather than to the foregoing description, in which it is intended to claim all modifications coming within the scope and spirit of the invention.

I claim:

1. A compactable furnishing unit comprising two chairs and a shaped body wherein each chair is characterized by a seating surface, an upwardly extending backrest and two upwardly extending arm rests, said unit being characterized in that said shaped body is adapted to fit into the area defined by the seating surface, backrest and armrests of one of said chairs and to extend upwardly beyond the top of said armrests and that the second chair of said unit is adapted to be inverted and to rest with its armrests on the armrests of said first chair and with a portion of said shaped body extending into the area defined by the seating surface, backrest and armrests of said second chair whereby the armrests of said second inverted chair are aligned with and maintained in position atop the armrests of said first chair by said shaped body and said unit of two chairs and a shaped body thereby form a compact unit, the combined height of the armrests of said first chair and the armrests of said second chair being substantially equal to the height of each of the backrests of said chairs whereby when said second chair is inverted onto said first chair the top surface of the backrest of each of said chairs is substantially continguous with the plane of the bottom of the other chair and further characterized in that the bottom of at least one of said chairs comprises a substantially flat surface adapted for use as a table when said chair is inverted atop the other chair, and the back of each chair is curved whereby the outer surfaces of the chairs of said unit in its compact state are substantially contiguous and define a substantially cylindrical shape and each of said chairs can be placed on its back on a floor surface and be adapted to serve as a sideway rocking chair.

2. A compactable furnishing unit as claimed in claim 1 wherein the chairs of said unit are made of molded plastic.

3. A compactable furnishing unit as claimed in claim 1 wherein the chairs and shaped body of said unit are hollow plastic and made by a centifugal rotary process.

4. A compactable furnishing unit as claimed in claim 1 wherein said shaped body is in the shape of a rectangularly shaped prism adapted for use as a table, stool or hassock.

5. A compactable furnishing unit as claimed in claim 1 wherein said shaped body is in the shape of a cylinder adapted for use as a table, stool or hassock.

* * * * *